US005423433A

United States Patent [19]

Arnold et al.

[11] Patent Number: 5,423,433

[45] Date of Patent: Jun. 13, 1995

[54] MATERIAL SEPARATOR APPARATUS

[75] Inventors: Robert G. Arnold; David M. Bills, both of Tulsa, Okla.

[73] Assignee: Osborn Engineering, Inc., Tulsa, Okla.

[21] Appl. No.: 239,325

[22] Filed: May 6, 1994

[51] Int. Cl.[6] ..... B03C 1/18

[52] U.S. Cl. ..... 209/636; 209/212; 209/223.1; 209/213; 209/225

[58] Field of Search ..... 209/212, 213, 219, 221, 209/225, 231, 228, 562, 563, 636

[56] References Cited

U.S. PATENT DOCUMENTS

| | | | |
|---|---|---|---|
| 2,989,029 | 5/1959 | Rueger | 209/219 |
| 5,080,234 | 1/1992 | Benson | 209/219 |
| 5,092,986 | 3/1992 | Feistner et al. | 209/219 |

*Primary Examiner*—Robert P. Olszewski
*Assistant Examiner*—Lisa A. Douglas
*Attorney, Agent, or Firm*—Head & Johnson

[57] ABSTRACT

A material separator apparatus having a continuous conveyor belt for support and transportation of materials to be separated and a motor to rotate the conveyor belt. The apparatus includes an electromagnet within the continuous belt to produce a magnetic field at the belt. An alternating current drives the electromagnet. This produces a magnetic field which in turn induces an eddy current in the materials to be separated. The eddy currents form the basis of a repulsive force which will produce different material trajectories based on the material properties such as conductivity and permeability. The wave form of the driving current is controlled to improve repulsive efficiency and help assist in differentiating among several classes of materials.

7 Claims, 5 Drawing Sheets

MATERIAL SEPARATOR APPARATUS

BACKGROUND OF THE INVENTION

1. Field of the Invention

The present invention is directed to a material separator apparatus wherein changing current in an electromagnet induces an eddy current in materials to be separated. The interaction of the eddy current with the original magnetic field by the Lorentz Force Law will generate a force on the object containing the eddy current. In accordance with Lenz's Law, this current will be in a direction to produce a repulsive force which can be used to alter the trajectory of the object and thus separate it from other materials. The more rapidly the driving current and thus the electromagnet's magnetic field changes the larger the generated eddy currents. Bipolar currents and magnetic fields in which the direction of the field completely changes will have no significant effects on non-ferrous conductive metals since the direction of the eddy current will also change accordingly. In ferrous metals, the repulsion produced by the eddy currents is small compared to the attractive force produced through the flux linkage with the ferrous metal. Reversing the current and the resulting magnetic field in the electromagnet more quickly than in the material to be separated produces a magnetic field of opposite polarity thus repulsing the material. In particular, the present invention makes use of these characteristics and provides a material separation apparatus wherein the rate of change of the alternating current driving an electromagnet is carefully controlled by a microprocessor to maximize the efficiency of the separator process and differentiate materials based on their conductivity and permeability.

2. Prior Art

One use of a material separator apparatus is in the recycling industry. One particular use is to separate materials generated from automobile vehicle refuse.

In one process, old vehicles are crushed and then shredded. The shredded materials will first be passed through an apparatus to remove ferrous metals which make up a significant portion of the metallic components, such as fenders, body materials and the like. The remaining material is then delivered to the present separator to separate non-ferrous metals therefrom.

The use of alternating magnetic fields to induce an eddy current in materials to be separated is well known. An area of rapidly changing high density magnetic flux is produced. As the materials pass through the area, they are subjected to the changing magnetic flux which induces an eddy current. These eddy currents in turn produce a Lorentz Force to change the direction of movement of the material.

At least two general procedures have been employed in the past. One procedure is to use a series of permanent magnets mounted on a rotor which are moved or rotated to produce an alternating magnetic field. The alternating magnetic field induces an eddy current in the materials so that a repulsive magnetic force is produced. A disadvantage of this type of separator is that a fast rotor speed is required to produce the desired eddy current. An example of this type of separator apparatus is shown in Siesco Jr. (U.S. Pat. No. 5,207,330). Another type of separator employs an electromagnet or magnets to produce a magnetic field. Examples of the use of an electromagnet are shown in Sommer Jr. et al. (U.S. Pat. No. 4,069,145), Reid (U.S. Pat. No. 5,064,075) and Benson, et al. (U.S. Pat. No. 3,448,857). The electromagnetic separators typically employ a single frequency (although adjustment of the frequency is possible) using a standard sinusoidal waveform. These electromagnetic separators also employ a unipolar single phase current drive circuit.

It is also known that the strength of the induced eddy current is proportional to the strength of the magnetic field and its rate of change. While it is possible to simply increase the frequency to increase the rate of change, the present invention controls the rate of change by controlling the waveform.

It is, therefore, a principal object and purpose of the present invention to control the alternating current waveform to maximize the eddy current produced and thereby maximize the efficiency of the separator apparatus.

SUMMARY OF THE INVENTION

The present invention provides a material separator apparatus that employs a microprocessor controlled, nearly square wave shaped alternating current. This current drives an electromagnet which induces eddy currents to produce repulsive magnetic forces between the electromagnet and the materials in which the eddy current is induced.

A continuous conveyor belt supports and transports materials to be separated. A motor or motors rotate a pair of drums or rotors supporting the conveyor belt. As the drums or rotors are rotated, the conveyor belt will be moved so that the materials are moved along the conveyor belt. A stationary electromagnet is permanently fixed by a bracket within one of the drums. The bracket is located about the axis of the rotor. The electromagnet produces a magnet field which passes through the drum and the conveyor belt so that materials on the conveyor belt pass through the magnetic field. An eddy current is induced so that magnetic fields are generated inside the target materials to be separated.

The magnetic field of the electromagnet is controlled by controlling the current passing through its coils. The induced eddy current will be greatest when the rate of change of the magnetic field is maximized as in the leading edge of a square wave. The maximum repulsive force is obtained by subjecting the material with the large eddy current created as above to a strong "constant" field as in the flat or square top of the square wave.

Switching of the current is accomplished in a control circuit driven by a central processing unit. The control circuit has push-pull drivers using bipolar signals requiting two signal lines. The control circuit is wired to a low power driving circuit. The low power circuitry uses the control signals to generate a higher power signal to control a high power driving circuit. The low power driving circuit includes controls for pulsing of the bipolar high power circuit.

The high power driving circuit, wired to the low power circuit, contains power transistors that control the flow of power through the electromagnet. The high power circuit is bipolar and multiphase. This circuit will allow the microprocessor to drive the magnet with a high power almost square wave whose characteristics can all be changed under program control.

In this manner, eddy currents are produced in the materials to be separated. The strength of the eddy current is proportional to both the strength of the magnetic field and to the rate of change in the magnetic field. The rate of change of the magnetic field is maximized by utilizing a square-shaped waveform for the current.

DETAILED DESCRIPTION OF THE PREFERRED EMBODIMENTS

Figure 1:
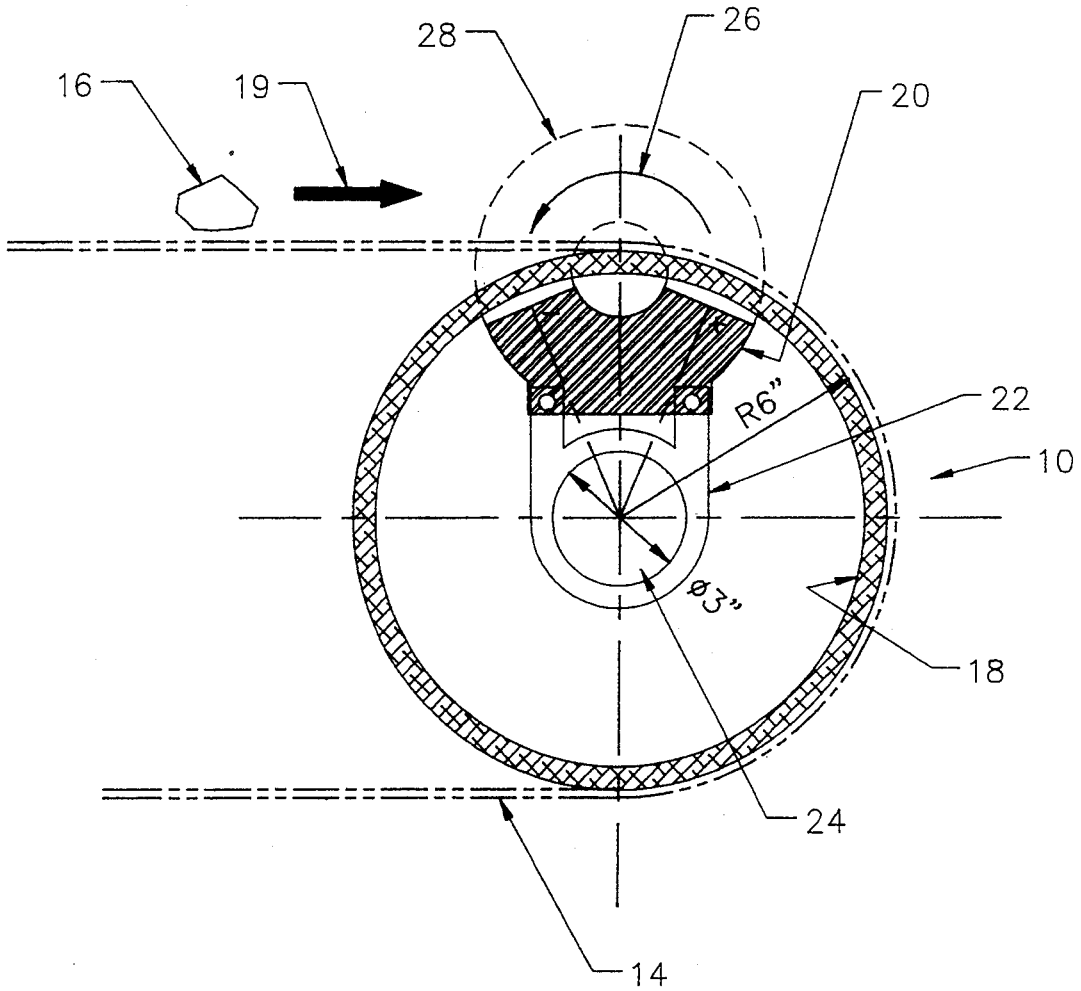
FIG. 1 is a diagrammatic representation of a material separator apparatus constructed in accordance with the present invention.

Referring to the drawings in detail, FIG. 1 illustrates a simplified, diagrammatic representation of a material separator apparatus 10 constructed in accordance with the present invention.

The material separator apparatus employs alternating current which is a microprocessor controlled wave shape that is almost square with time. It rises from zero to a maximum valve in one direction and decreases back to zero. It then rises to a maximum value in the opposite direction and decreases to zero. This current drives an electromagnet made with a core material suitable for use in high frequency applications which will rapidly change the direction of the magnetic field. This electromagnet induces eddy currents in the material passing over it being carried on the conveyer belt 14. The eddy currents are induced during the rapid change in the magnetic field produced by the leading (or falling) edge of the square wave driving current.

A continuous conveyor belt 14 (only a portion visible) supports and is used to transport a multitude of materials 16 to be separated. A motor or motors (not shown) is used to rotate a pair of rotors or drums 18 (one of which is visible in FIG. 1) about which the conveyor belt is passed and which support the belt. As the rotor or drums are rotated, the conveyor belt 14 will be moved so that the materials 16 are moved along the conveyor belt in the direction shown by arrow 19. A stationary electromagnet 20 is permanently fixed by a bracket 22 or other means within one of the rotors or drums. Since the electromagnet is independent of the rotor or drum, the speed of the rotor has no effect on the eddy current produced.

The bracket 22 is located about the axis 24 of the rotor. The bracket is movable about the axis 24 so that the position of the electromagnet may be changed from time to time.

As illustrated by arrow 26 and dashed lines 28, the electromagnet 20 produces a magnetic field which passes through the rotor 18 and the conveyor belt 14 so that materials 16 on the conveyor belt will pass through the magnetic field.

As will be described herein, the magnetic field is rapidly varied so that eddy currents are generated inside the target materials 16 to be separated. The eddy currents interact with the magnetic fields themselves as described by Lorentz Law and Lenz's Law. This interaction is the basis of repulsive forces created by the magnetic field. The factors of conductivity and permeability of materials are the most important factors differentiating the repulsion of the materials.

A repulsive force is produced so that the materials to be separated are repelled or thrown from the belt.

Figure 2:
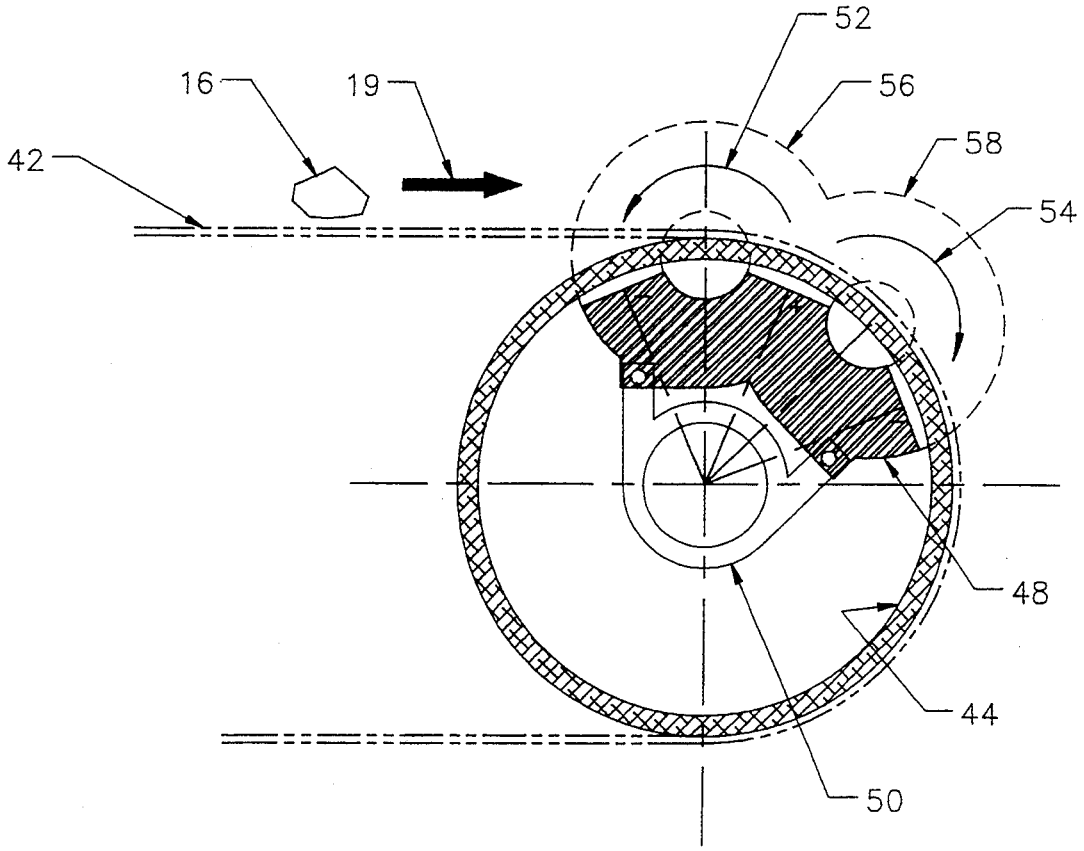
FIG. 2 is a diagrammatic representation of an alternate embodiment of a material separator apparatus constructed in accordance with the present invention having a pair of electromagnets.

FIG. 2 illustrates an alternate embodiment of the material separator apparatus 40 of the present invention. A conveyor belt 42 is moved by a pair of rotors 44 (one visible in FIG. 2) so that the materials 16 will travel in the direction shown by arrow 46. The alternate embodiment 40 employs a pair of electromagnets 48 mounted on a bracket 50. The bracket is located and movable about the axis of the rotor so that the position of the electromagnets may be changed from time to time.

As illustrated by arrows 52 and 54 and by dashed lines 56 and 58, the electromagnets 48 produce a magnetic field which passes through the rotor 44 and the conveyor belt.

Figure 3:
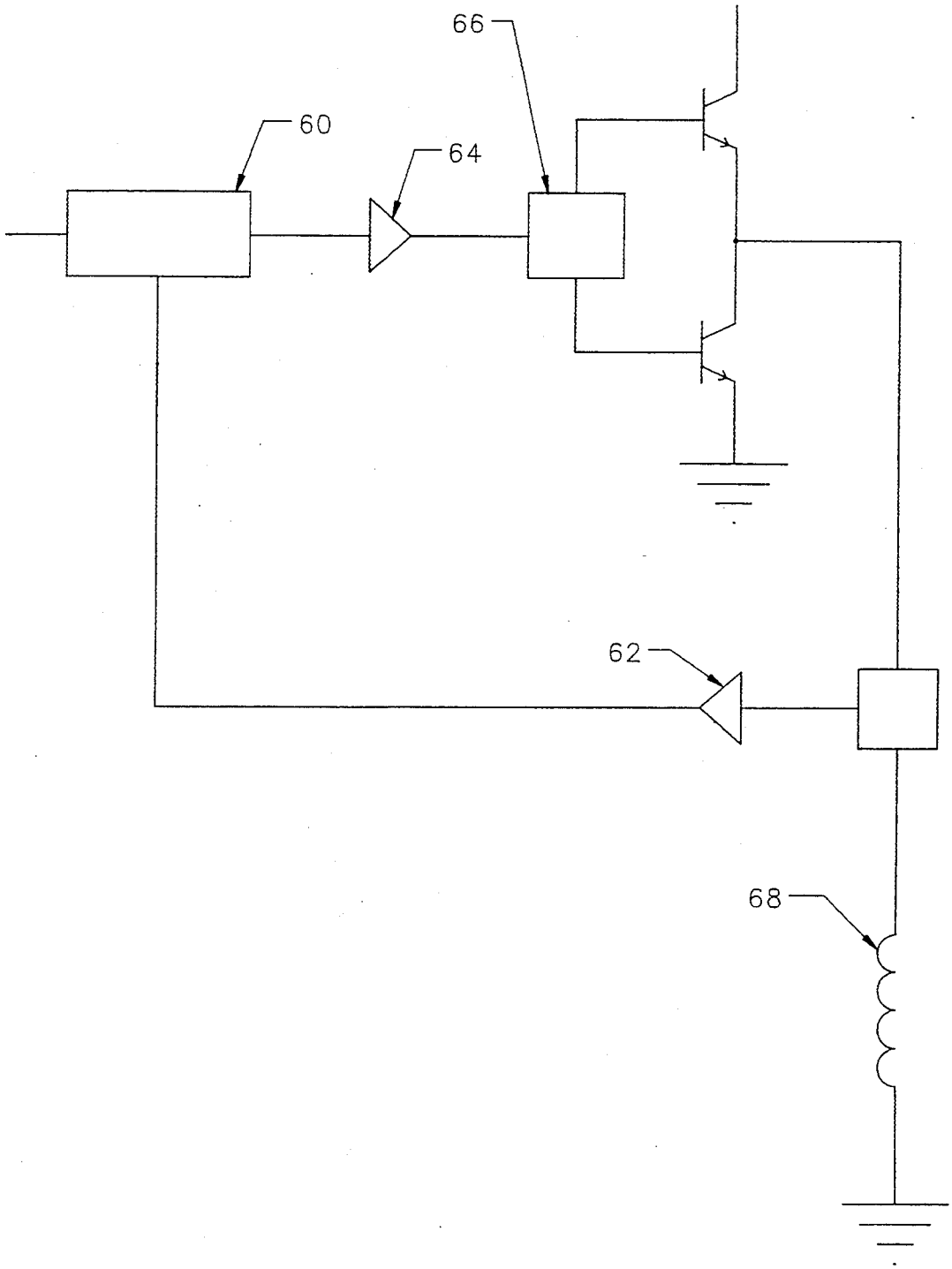
FIG. 3 is a schematic diagram showing the circuitry of the apparatus in accordance with the present invention.

FIG. 3 illustrates a schematic diagram chart of the switching and electrical mechanism used to produce an alternating current and the resulting eddy current in the materials to be separated.

Switching of the current is accomplished in the control circuitry by an oscillator and a central processing unit.

The layout of the electrical eddy current system is based on a bi-polar and bi-phase system. The circuit is broken up into several modular parts. The first of these is the timing and control system 60, which generates the basic frequency of operation of the system. The second component is the current sensing circuit 62 that reads the current in the magnet to determine when to switch the power units. The third component is a medium power driving circuit 64 that amplifies the current to drive the power transistors. The fourth set of components is the power transistors 66 that control the current through the magnet. The fifth set of components is the magnet 68 and the protection circuit for overvoltage.

The first circuit, the timing and control system 60, is microprocessor based. This system will determine the basic frequency at which the system operates. The average range of current operating machines is from 200–400 Hertz. This value will change depending on material characteristics, and shape. The circuit will be able to drive operate at frequencies of up to 10,000 Hertz. These frequencies will work well for very small materials (less than $\frac{1}{8}$"). With larger materials (1" to 4") an operating frequency of around 300 Hertz will be used. The timing mechanism is based on a circuit that uses the current sensing circuit for feedback. This would allow a more complex system that can generate a band-pass filter to separate particular types of materials with greater accuracy than a single basic frequency, which works only as a high-pass filter.

The current sensing 62 uses a current to voltage transducer to measure the current to the magnet. A differential operational amplifier is driven by this transducer. The differential op amp can then be read by two devices for switch control. The simplest of these is a comparator. This device will need to read both the negative limit and the positive limit of the current through the magnet. This will in turn drive the medium power circuits. When a positive current is sensed, just below the desired operating current, the comparator will signal the medium power circuit to switch over from a high voltage, rapid rise mode drive ("fast-switching") to continuous power mode. The negative polarity comparator will operate in a similar fashion for the negative polarity medium power circuit.

The medium power circuit consists of several medium power transistors that operate in a Darlington array fashion to amplify the driving current for the high power transistors. The medium power circuit must also be able to use a "floating ground" system, and hence includes optically isolated transistors to compensate. The optically isolated system is only required on the positive side of the circuit. The medium power circuit is capable of halting current flow at any fixed level, and switch between "fast-switching" current, "continuous power" current, and no current. The use of a microprocessor and "no current" is required to generate a band-pass system for separation. The change from "fast-switching" current to "continuous power" current is driven by the current sensing circuitry. The medium power circuit is designed to work with the maximum voltage levels of the high power circuit, but at a much lower current range.

The high power circuit involves using two different voltage levels. Using a relatively low voltage is required for a "continuous power" current in the magnet. This voltage can be as low as 10 volts. The use of a relatively high voltage is required to generate a "fast-switching" current, which is required to force the current in the magnet to change polarities as fast as the circuit can handle. This value can be around a factor of 10 or more higher than that of the continuous power case. Higher voltage levels will increase the rate of change in the switching of the magnet's current. This value is limited only by the breakdown voltage of the driving transistors. The "fast-switching" current mode will only be active for a very brief period during each half cycle of the driving waveform. The current sensing circuit is required to limit the "fast-switching" current and determine the time to switch modes.

The last circuit, the magnetic circuit, in its simplest sense, is just an electro-magnet. The electrical eddy-current system also includes some protection circuits to correct for voltage-spikes from the induction component of the magnet. There is also a small component of the circuit found in the materials that are to be effected by the eddy-current process. The components in the magnetic circuit describe the reaction rate, or force on the material to be processed. A magnetic winding with very little resistance is required for the magnet. Also the magnet must be able to withstand a large current. This means that the magnet must be made from large gauge conductors, with fewer windings than a normal, industry standard electro-magnet. The core material of the magnet also dramatically effects the rate of switching, and the inductive properties of the magnetic circuit. A magnetic core material is required with the largest amount of permeability as possible. The combination of the "fast-switching" voltage, the magnet's characteristics, and the properties of the material being processed will determine the amount of force generated in the processed material.

OPERATION

The system may be operated at high frequencies, thus giving materials with high conductivity, or materials with small surface area, a greater force than larger materials. This is effectively a high pass filter.

The system may have dead spots between the positive of one phase and the positive of the second phase of the bipolar output of the control circuit. This would be used to allow materials with low conductivity to have normal force, while materials with high conductivity would lose most or all of the force components, which creates a low pass filter. Using both the low pass and high pass filter approaches allows the apparatus to separate a particular type of material, based on its characteristics of permeability and conductivity.

The frequency system could also be multi-spectrum, where two or more frequencies are represented in the bipolar pulse train, with one long set of pulses followed by one small set of pulses. This could be repeated continuously, and would effect two different types of materials with better power than using a single frequency that was averaged between the two different materials.

The microprocessor based central processing unit is the primary controller of the electrical eddy current system. This would allow complex schemes of material flow, and material separation. As an example, two different waveforms could be produced in sequence. It is believed that one machine could separate many types of metals having different conductivity and permeability with very high accuracy. As an example, the present invention could separate both ferrous and non-ferrous materials.

Initially the system uses the pulse lines to activate capacitors that drive the initial current spike, to reverse the polarity of the electromagnet. Then the pulse lines are shut off, and the duration of the phase is controlled by the trigger lines that are connected directly to the power source. The majority of the power in the circuit is transferred from one capacitor to the other in rapid succession, through the electromagnet, which gives the alternating magnetic field, which is responsible for the mechanical force. Very little power is consumed by the circuitry itself.

Figure 4:
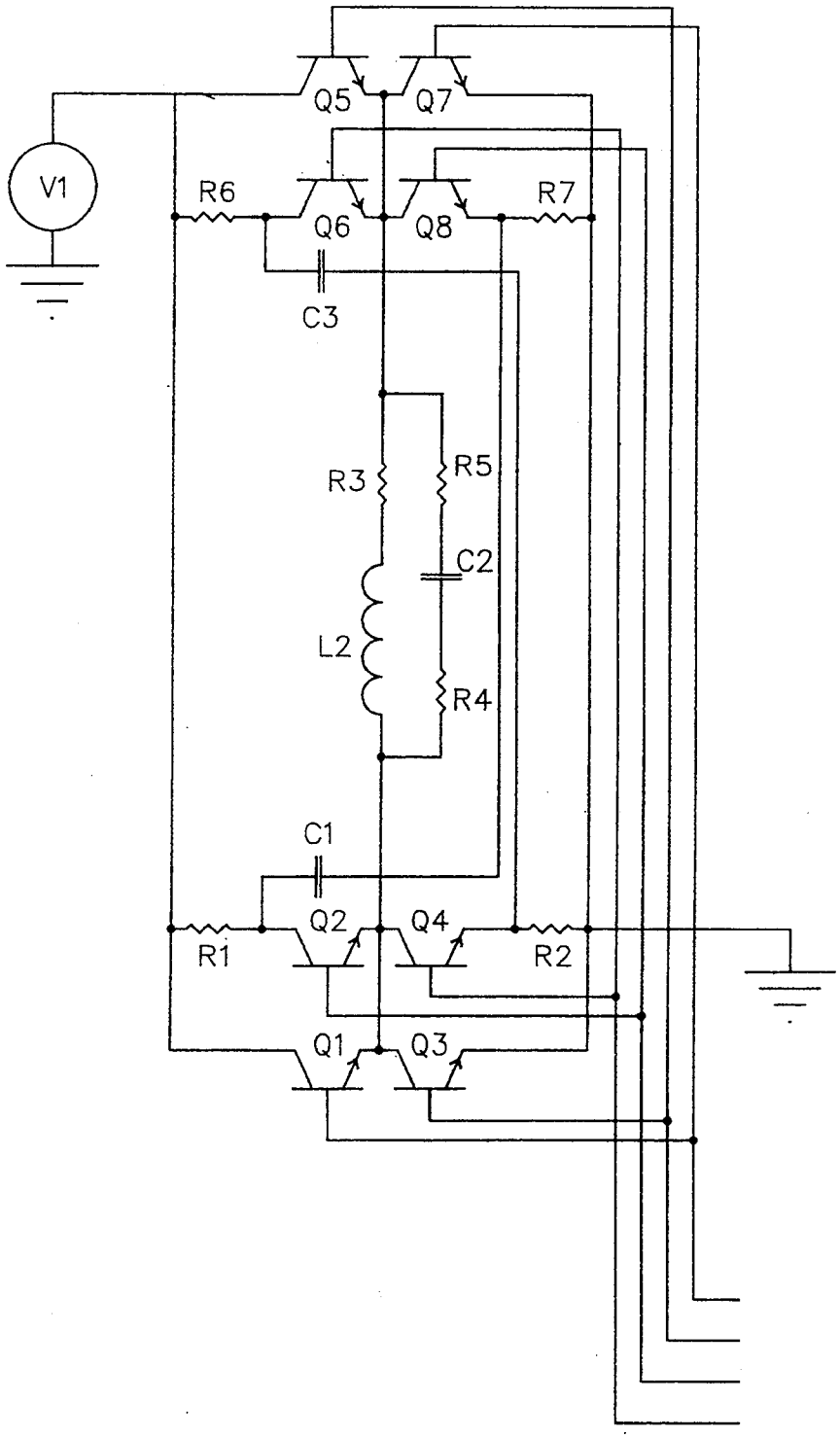
FIG. 4 is a schematic diagram of the high powered driving circuit of the material separator apparatus of the present invention.

FIG. 4 illustrates a schematic diagram of a high power driving circuit.

The following is a brief description as to the operation of one phase of one pole of the high power system. The operation is mimicked on the other phases, and poles.

Q1—Transistor—Controls the connection to the main power supply, after the pulse system is done and operates as a digital switch.

Q2—Transistor—Controls the current in the pulse portion of the control signal. This transistor opens before Q1 and allows the capacitor to discharge through the inductor network (electro-magnet).

R1—Resistor—This resistor is effectively closed during the time that the pulse is generated, but when the pulse is inactive, it slowly feeds power to the capacitor.

C1—Capacitor—This part stores power during the time when the pulse is inactive, to release all of it during the active portion of the pulse. Since the pulse comprises less than 5% of the total phase of the system, the capacitor may generate over twenty times the power of the normal power supply.

R4, R5—Resistor—These two resistors determine the amount of voltage spike compensation that is set on the electromagnet.

C2—Capacitor—This capacitor stores the charge for the voltage spike compensation network.

The end effect of the fourth area of magnetic transfer fields is to produce a physical force on a material type that in turn causes a repelling action by the material itself. This is caused by eddy currents being generated inside the target material.

In current machines that create eddy currents to induce physical repulsion in materials, all use the basic sinusoidal form as their time constant. Using something that approaches a square wave, the effective force can be increased significantly, allowing the overall power to be reduced, thereby reducing the cost of the machine, or increasing the overall power of the system.

As an example, in one embodiment, 20 amperes of current at 500 watts was used.

The present invention produces a greater slope of the wave than previously possible. In one embodiment, the rate of change was approximately 350,000 A/sec.

The factors of conductivity, and permeability are both the most important factors in considering the operation of the electrical eddy current machine. An important point to mention, is that as the rate of change of the slope of the magnetic field increases towards infinite, the permeability of the material plays less of a role. The physical limit of the rate of change in the magnetic field is limited by the hysteresis loss and switching characteristics of the material that comprises the magnet itself.

As the molecules of the core reverse their direction with each change of magnetism, molecular friction results. Power is required to overcome this molecular friction. This loss occurs as heat in the metallic structure and is known as hysteresis loss.

With an iron core magnet, similar materials will always be attracted, since the materials will switch internal fields as fast as the magnet itself. If a nonstandard material is used in the magnet, such as super-malloy, then a higher rate of change can be made, therefore maximizing the physical force that creates the repulsion. For most applications, a normal core material should be sufficient. Materials that have special properties, or materials that are physically smaller than normal may require the faster core materials.

Figure 5A:
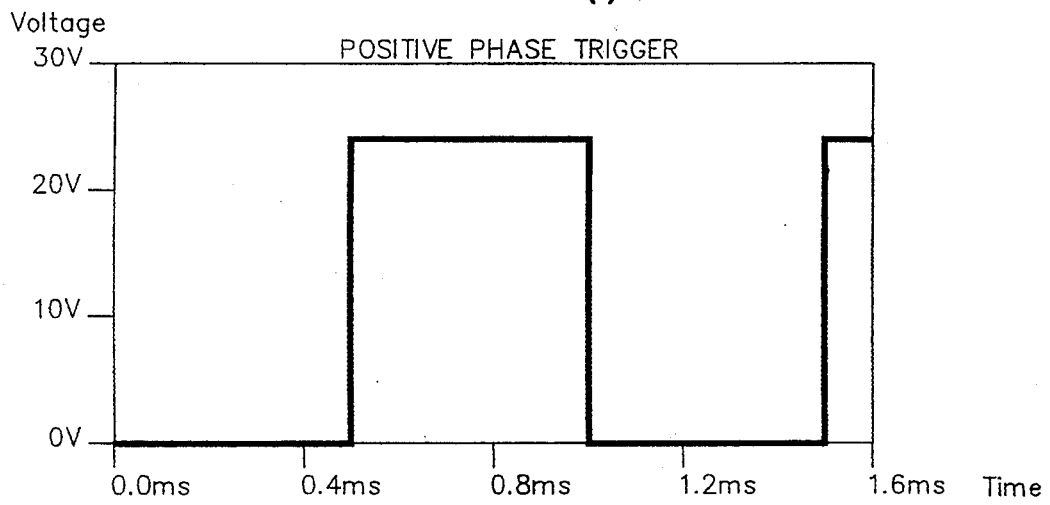
FIG. 5 is a chart showing an example of a current waveform produced by the material separator apparatus of the present invention.
Figure 5B:
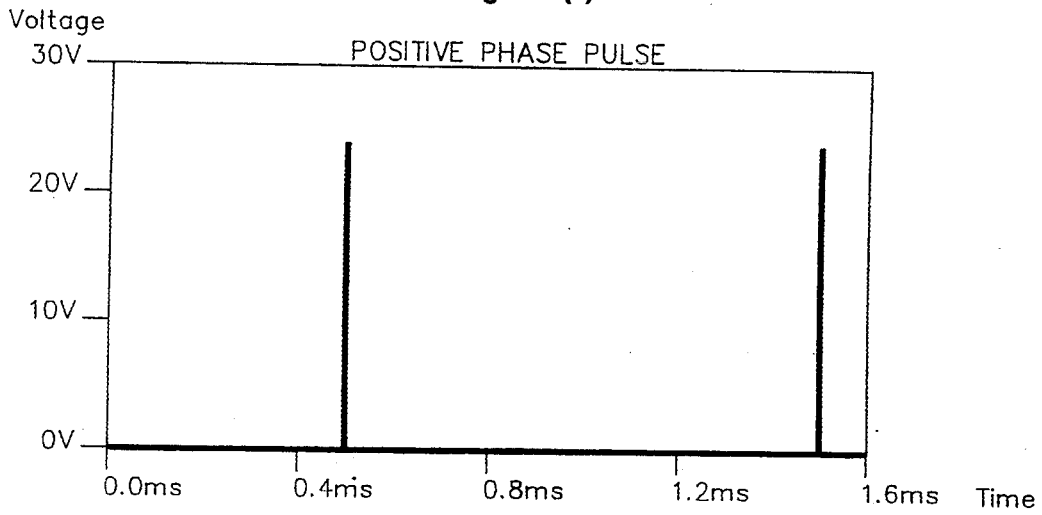
Figure 5C:
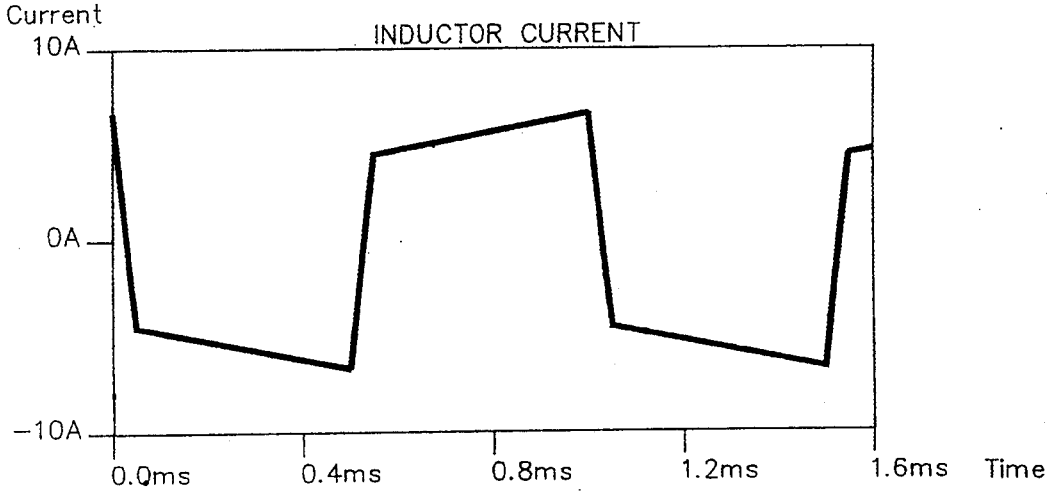

FIG. 5 is a chart of one current waveform produced by the present apparatus. The vertical axis shows amperes while the horizontal axis shows milliseconds. It will be observed that the waveform is substantially square-shaped as opposed to sinusoidal.

Whereas, the present invention has been described in relation to the drawings attached hereto, it should be understood that other and further modifications, apart from those shown or suggested herein, may be made within the spirit and scope of this invention.

What is claimed is:

1. A material separator apparatus having a continuous conveyor belt for support and transportation of materials to be separated, and motor means to rotate said conveyor belt about an axis, which apparatus comprises:

an electromagnet within said continuous belt to produce a magnetic field at said belt;

means to produce an alternating current in said electromagnet to induce an eddy current in said materials; and means to control a wave form of said alternating current to maximize repulsive efficiency of said eddy current.

2. A material separator apparatus as set forth in claim 1 wherein said means to control the waveform of said alternating current includes timing and control means having a central processing unit; current sensing feedback circuit; and rapid rise/fast switching and continuous power circuits.

3. A material separator apparatus as set forth in claim 1 wherein said electromagnet is mounted about the axis of said continuous conveyor and is movable radially about said axis.

4. A material separator apparatus as set forth in claim 1 wherein said alternating current has multiple frequencies.

5. A material separator apparatus as set forth in claim 4 wherein said multiple frequencies are staggered sequentially.

6. A material separator apparatus as set forth in claim 1 wherein said alternating current is both bipolar and multiphase.

7. A material separator apparatus as set forth in claim 6 including a low power driving circuit which controls and generates a high power driving circuit.

* * * * *